US006039154A

United States Patent [19]

Moll et al.

[11] Patent Number: 6,039,154

[45] Date of Patent: Mar. 21, 2000

[54] BRAKING MEANS FOR A MOVABLE PART OF A FURNITURE COMPONENT, ESPECIALLY AN UPHOLSTERED FURNITURE COMPONENT

[75] Inventors: Reiner Moll, Schwäbisch Gmünd; Helge Fedderke, Neuss; Christoph Hartmann, Aachen, all of Germany

[73] Assignee: Thomas Jungjohann, Ertingen, Germany

[21] Appl. No.: 08/917,934

[22] Filed: Aug. 27, 1997

[30] Foreign Application Priority Data

Aug. 29, 1996 [DE] Germany ..... 196 34 807
Sep. 18, 1996 [DE] Germany ..... 196 38 075

[51] Int. Cl.[7] ..... B65H 59/10

[52] U.S. Cl. ..... 188/67; 297/318

[58] Field of Search ..... 188/67, 83, 39, 188/41; 193/35; 297/318

[56] References Cited

U.S. PATENT DOCUMENTS 5,086,903 2/1992 Agnoff ..... 193/35 A

FOREIGN PATENT DOCUMENTS 0 156 814 2/1988 European Pat. Off. .
0 393 232 3/1993 European Pat. Off. .
23 61 767 6/1973 Germany .
2360855 A1 6/1975 Germany ..... 297/318
25 24 568 12/1976 Germany .
27 23 709 11/1978 Germany .
80 25 516 1/1981 Germany .
30 33 953 5/1981 Germany .
31 10 111 9/1982 Germany .
85 34 420 3/1986 Germany .
86 09 844 7/1986 Germany .
93 11 345 11/1993 Germany .
44 05 653 8/1994 Germany .
94 15 493 1/1995 Germany .
195765 2/1938 Switzerland ..... 188/67
WO 95/25452 9/1995 WIPO .

*Primary Examiner*—Mark T. Le
*Assistant Examiner*—Pamela J. Lipka
*Attorney, Agent, or Firm*—Sixbey, Friedman, Leedom & Ferguson; David S. Safran

[57] ABSTRACT

A braking means for a movable part of a furniture component, especially an upholstered furniture component, which has support frame (1), with a slide rail (7) to be attached to either of a movable part (3) and a support frame (1), and with a brake bearing block (8) to be attached to the other of the support frame (1) and movable part (3), an adjustment device (9) for adjustment of the braking force exerted by the brake bearing block (8) on the slide rail (7) being provided on the brake bearing block (8). Especially sensitive adjustability and a small starting jerk are accomplished in this braking device by the bearing block (8) having two brake rollers (11) which roll on opposite brake surfaces (10) of the slide rail (7). As an alternative, the brake bearing block (8) is located within a crosspiece (6) through which the slide rail (7) penetrates.

9 Claims, 3 Drawing Sheets

BRAKING MEANS FOR A MOVABLE PART OF A FURNITURE COMPONENT, ESPECIALLY AN UPHOLSTERED FURNITURE COMPONENT

BACKGROUND OF THE INVENTION

The invention relates to a braking means for a movable part of a furniture component, especially an upholstered furniture component, such as sitting and reclining furniture with correspondingly movable parts (armchairs, upholstered chairs, lounge chairs, bus, rail and aircraft seats, reclining furniture). In particular, the invention relates to an upholstered furniture component which has a support frame with a slide rail to be attached to a movable part or to a support frame and with a brake bearing block to be attached to the other of the support frame or movable part, preferably with an adjustment means for adjustment of the braking force exerted by the brake bearing block on the slide rail being provided on brake bearing block.

DESCRIPTION OF RELATED ART

A furniture component on which a braking means of the type under consideration can be implemented is especially an upholstered furniture component, specifically an upholstered armchair as is known in different embodiments from International Application Publication WO-A-95/25452. For the known upholstered furniture component, a coupled backrest and seat adjustment is provided. This backrest and seat adjustment uses a connection mechanism between the support frame, the backrest and the seat to accomplish synchronous adjustment of the backrest and seat from a topmost upright position, i.e., the sitting position, into a bottommost, preferably even further extended position, i.e., the reclining position. In the movement from the sitting position into the reclining position, the seat executes a slight movement which has a considerable translational (sliding) component.

To prevent uncontrolled sliding motion of the seat, that is, to make it controllable, there is a braking means between the seat and support frame which has a slide rail which normally made of metal and which is attached to the movable part, to the seat, or optionally also to the support frame, and a brake bearing block is assigned to it, on the opposite part, therefore, on the support frame, or also on the movable part.

An easy-chair with an adjustable back support is known from German Utility Model DE U 86 09 844 in which an adjustment device on the brake bearing block is used to adjust the braking force exerted by the brake bearing block on the slide rail. But, the exerted braking force can lead to jamming.

It is also known from German Utility Model DE U 85 34 420 to provide for the braking action in adjustable seating furniture to be accomplished by sliding friction, that is structurally dictated beforehand, between the bearing surfaces of the slide rail and brake bearing block without an adjustment means on the brake bearing block.

One problem in all known braking means of the type under consideration is that the braking force cannot be adjusted sensitively enough and especially that, at the start of the adjustment motion, a considerable resistance must be overcome if, specifically, static friction becomes sliding friction (starting jerk). In addition, adjustment can often only be done with difficulty.

For seating furniture components with a coupled backrest and seat adjustment in which it is important that the body position can be easily changed by weight shifting, the aforementioned difficulties of known braking means have a deleterious effect on comfort.

SUMMARY OF THE INVENTION

A primary object of the present invention is to improve the braking means of the type under consideration to solve the above described problems.

The aforementioned object is achieved in a first embodiment in a braking means initially mentioned by providing the brake bearing block with two brake rollers which roll on opposite brake surfaces of the slide rail. In accordance with the present invention, a systematically different braking means is used, specifically a braking means with brake rollers, with which sliding friction is replaced by rolling friction. This leads to much more sensitive adjustability of the braking force. In particular, this leads to the starting jerk being effectively reduced. Only the static friction, which is still present in the bearing of the brake rollers, but which can be minimized, must be overcome in order to then accomplish only rolling friction.

The aforementioned object is achieved in a second embodiment in which a fundamentally similar braking means with braking surfaces is used, but it is especially cleverly integrated into the crosspiece on the support frame (or on the movable part).

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
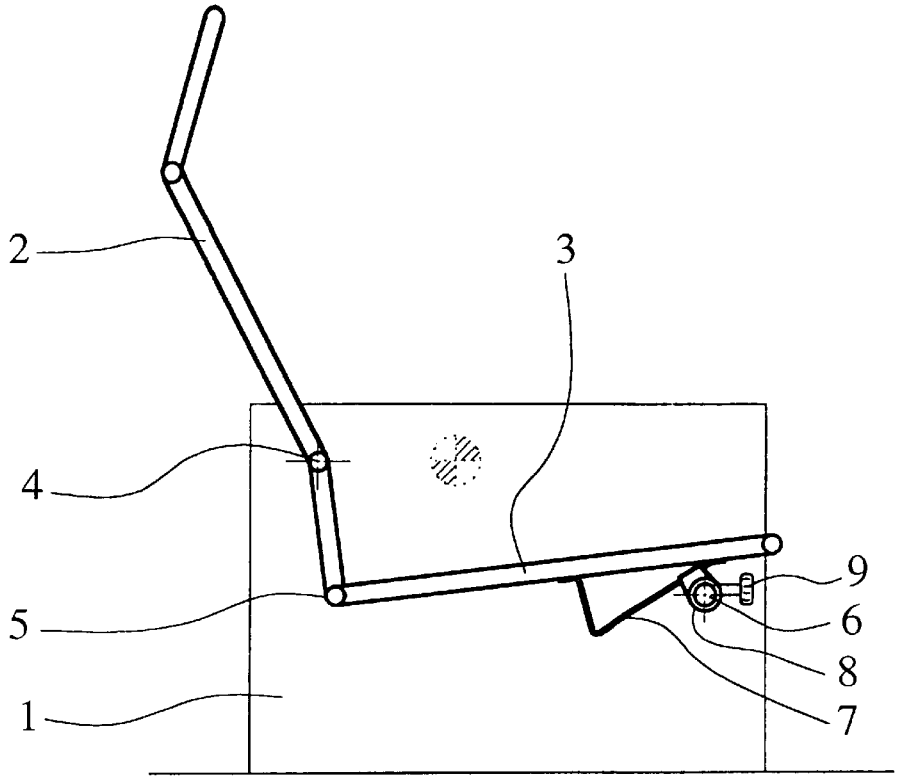
Fig. 1 (Prior Art)
FIG. 1 shows one embodiment of a seating furniture component known from the prior art in the sitting position.

The braking means shown in the drawings are intended and suitable for a movable part of a furniture component, especially for a movable part of a seating furniture component and especially, as described specifically here, for the movable seat of a furniture component in which coupled backrest and seat adjustment is accomplished.

Figure 2:
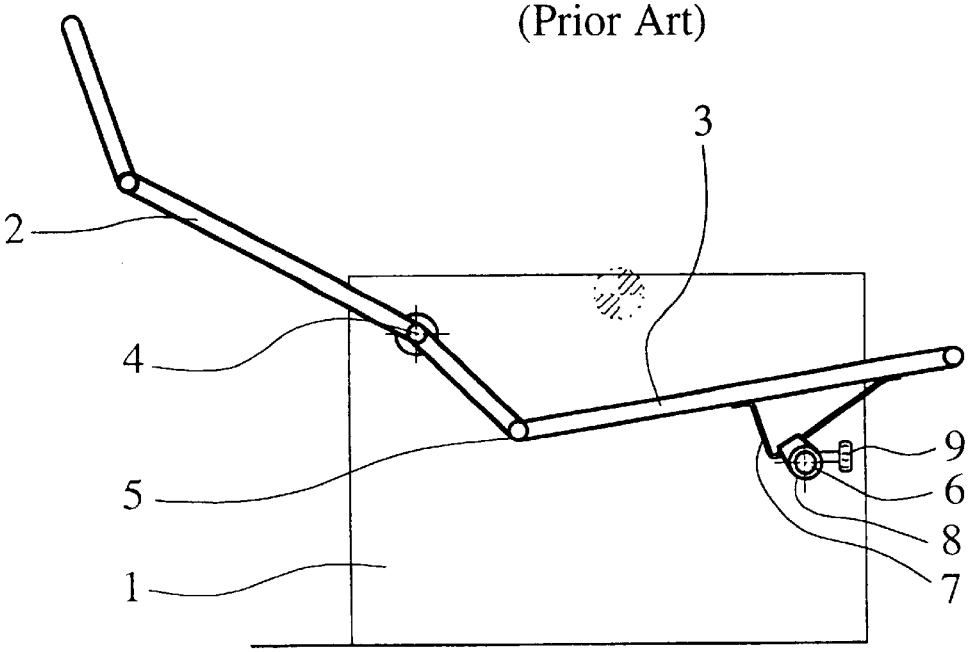
Fig. 2 (Prior Art)
FIG. 2 shows the seating furniture component from FIG. 1 in the reclining position.

FIGS. 1 and 2 show, first of all, a backrest 2 and seat 3 on a support frame 1 of a seating furniture component made as an upholstered armchair. Backrest 2 is pivotally mounted on support frame 1 on a pivot bearing 4. Backrest 2 is hinged to seat 3 at an angle via a pivot joint 5. Under the front edge of seat 3, there is crosspiece 6 in support frame 1 which bears seat 3. A slide rail 7 is provided on the bottom of seat 3 in the area of crosspiece 6. More specifically, on the front edge of seat 3 in the area of crosspiece 6, there is a slide rail 7 on each side of support frame 1. But, in the figure, only one slide rail 7 can be seen, as a result of the direction of the view shown. Seat 3 represents a movable part of a furniture component, here, an upholstered armchair, which is of conventional construction to the extent described so far.

On support frame 1, a brake bearing block 8 is attached to crosspiece 6. Brake bearing block 8 forms a slide guide for slide rail 7. Slide rail 7, therefore, slides in brake bearing block 8 with stipulated sliding friction as the armchair is shifted from the sitting position to the reclining position.

For this reason, a toggle T (illustrated by a broken line in FIG. 3) is provided on brake bearing block 8 and forms, together with a manually turnable knob 9 having a threaded shaft, an adjustment means for adjusting the braking force exerted by brake bearing block 8 on slide rail 7 in the preferred embodiment shown. With this toggle, the slide bearing in brake bearing block 8 for slide rail 7 is more strongly or less strongly tensioned, so that the sliding resistance changes accordingly. In this way the movable part of the furniture component, therefore seat 3 of the upholstered armchair, can be adjusted against a pre-selectable force, and with a corresponding configuration of the braking means of slide rail 7 and brake bearing block 8, can also be fixed or locked in certain positions.

Figure 3:
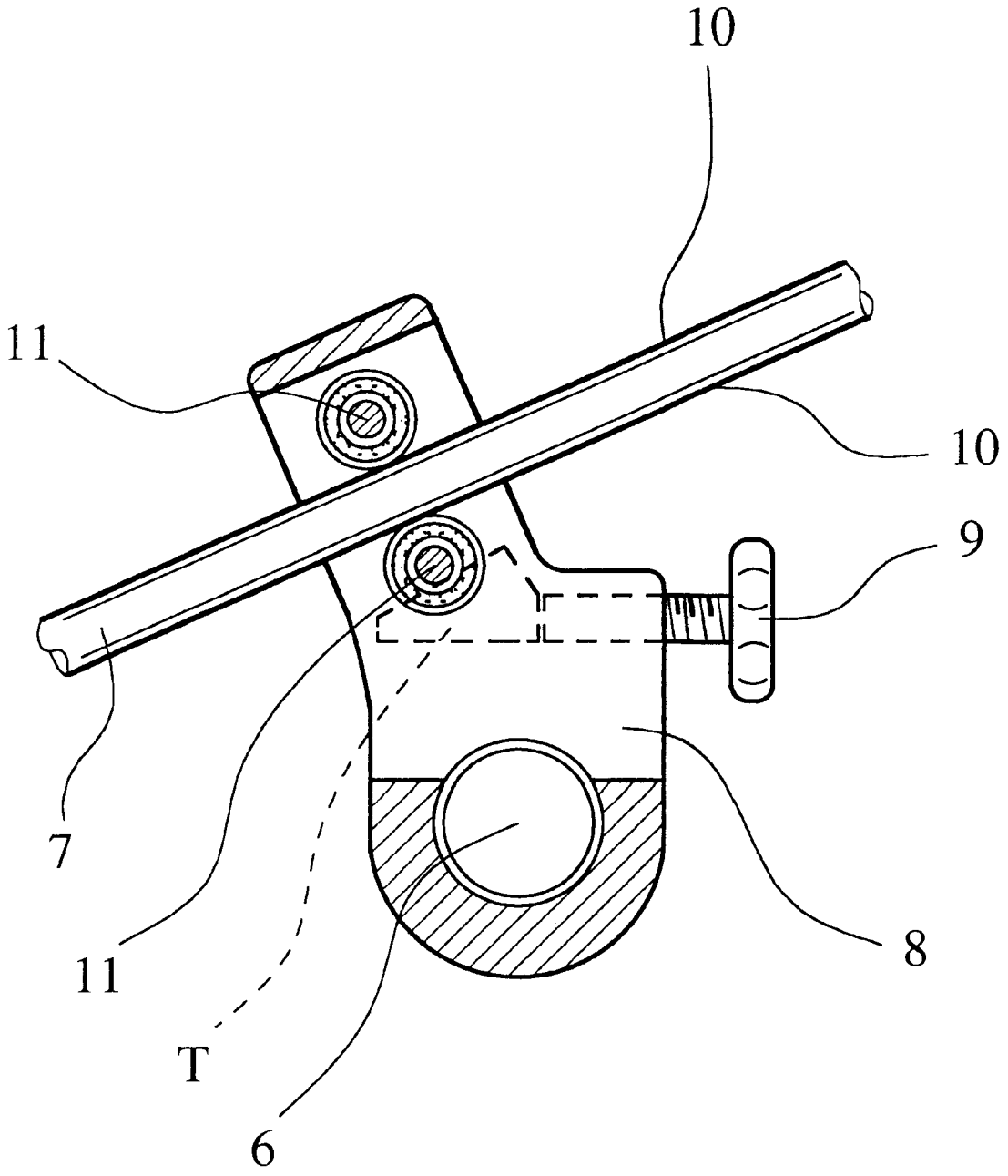
FIG. 3 is an enlarged representation in schematic form of the braking means of the present invention for use in the seating furniture component of FIGS. 1 & 2.

More specifically, FIG. 3 shows a braking means for movable part 3 of a furniture component in which the brake bearing block 8 has two brake rollers 11 which roll on opposite brake surfaces 10 of slide rail 7. Braking of slide rail 7 with brake rollers 11 has the advantages that, not only is the adjustability of the braking force especially sensitive, but the starting jerk is also greatly reduced in particular. In this way, high demands for comfort are met when using a furniture component with this braking means.

The braking means can be used not only in seating furniture components, although it is especially feasible there for the seat, but this braking means can also be used for other movable parts of furniture components. For example, the braking means can be used for a recliner with a movable head part or movable foot part.

FIG. 3 shows that brake rollers 11 guide the slide rail 7 between themselves. For doing so, the brake rollers 11 can be made not only as flat rollers, but also, for example, as tapered rollers with a wedge-shaped or U-shaped peripheral groove, which then interact with an appropriately shaped slide rail 7. As one alternative, which is not shown here, the slide rail 7 can be made U-shaped and the brake rollers 11 can be adjusted from the inside of the U-shape against the legs thereof.

The brake rollers 11 in brake bearing block 8 are supported on ball bearings. The use of ball bearing to support the brake rollers 11 has the advantage of lower frictional resistance; this leads to optimization of the starting jerk.

Furthermore, in this embodiment it is provided that brake rollers 11 are coated with an elastomer layer or are made of elastomer material, especially as solid rubber rollers. By means of the contact pressure of brake rollers 11 on slide rail 7 they are elastically deformed in the support area, i.e., pressed in; this increases or decreases the rolling resistance of brake rollers 11 on slide rail 7 depending on the contact pressure exerted. Thus, an especially feasible, sensitive adjustment of the braking force is ensured.

It has already be pointed out that it is especially desirable to enable the prestress of the brake rollers 11 to be adjustable with respect to the slide rail 7. To do this, preferably, the brake rollers 11 are adjustable with respect to the slide rail 7 in brake bearing block 8. This adjustment is produced by turning of the adjustment knob 9 so that its shaft shifts the toggle T, pushing lower brake roller 11 in brake bearing block 8 toward the upper brake roller 11 which is positioned above slide rail 7.

It is also possible to provide adjustment means with its own spring element which produces an elastic coupling within adjustment means.

Adjustability of the rolling resistance of brake rollers 11, for example, by a corresponding bracing of the bearings is also possible.

A second embodiment of a braking means will now be explained using FIGS. 1, 2, 4 and 5.

Figure 4:
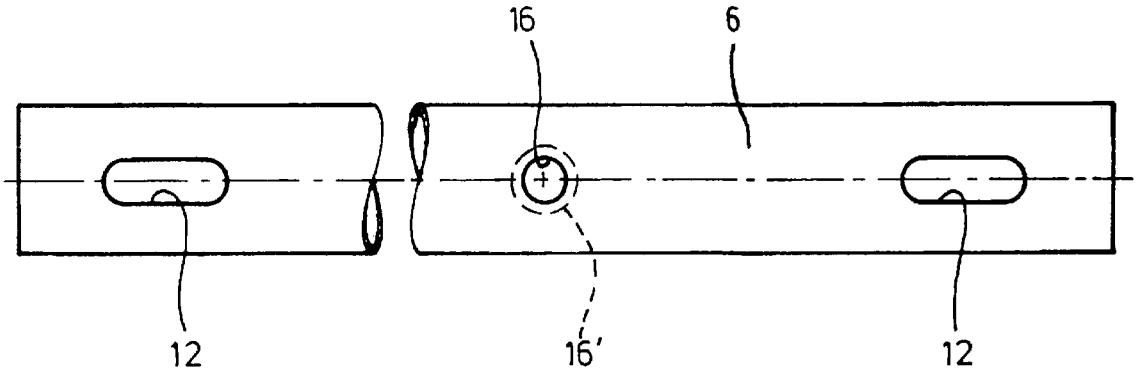
FIG. 4 shows in schematic form a crosspiece for a furniture component with an alternative braking means.

In this braking means, crosspiece 6 is made as a hollow section or as a tube and is attached to support frame 1 (or to the movable part) and is used for integration of the braking means. For this purpose, as can be recognized especially well in FIG. 4, it is first of all provided that tubular crosspiece 6 has through-openings 12 for slide rail 7, which thus penetrates crosspiece 6. FIG. 4, on the right, has two through-openings 12, one behind the other, of which here, only front through-opening 12 for slide rail 7 is visible, and corresponding through openings 12 are also provided on the left for the other slide rail 7, which is on the left side of the support frame 1. The slide rails 7, themselves, are not shown in FIG. 4.

Figure 5:
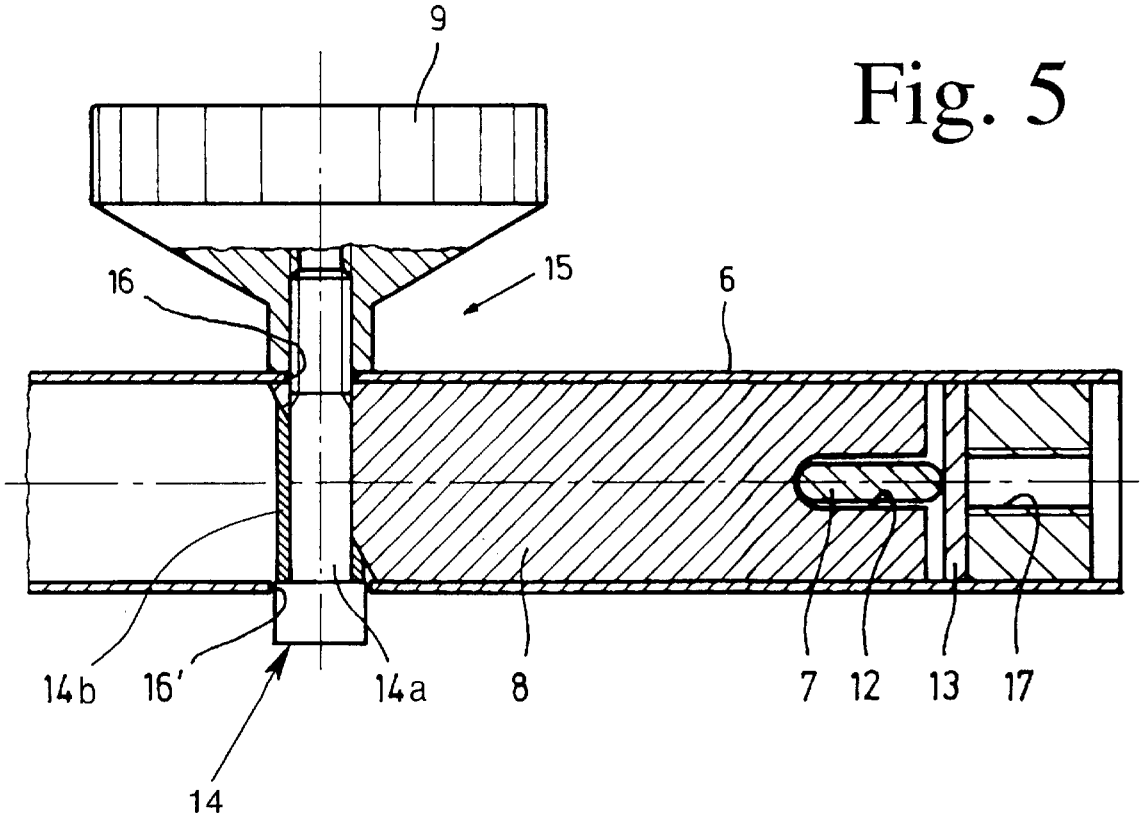
FIG. 5 partially broken-away view of the braking means in the crosspiece from FIG. 4.

FIG. 5 in conjunction with FIG. 4 shows that, in this case, the brake bearing block 8 is integrated into the interior of the tubular crosspiece 6 instead of being seated on crosspiece 6, as shown for the prior art example of FIGS. 1 and 2, and thus, is hidden within crosspiece 6. For this reason, brake bearing block 8 is inserted into the crosspiece 6 and guided into the area of through openings 12 for slide rail 7. This is shown in FIG. 5 for slide rail 7 which is on the right; it can be provided accordingly on the left.

The adjustment means is likewise located on crosspiece 6 and to adjust the braking force presses brake bearing block 8 in the interior of crosspiece 6 against slide rail 7. Brake bearing block 8 can be moved within crosspiece 6 by the adjustment means which, in this embodiment, comprises a thrust bearing block 13 which is securely located in the crosspiece 6 on the side of slide rail 7 facing away from brake bearing block 8, and against which the slide rail 7 can be pushed by brake bearing block 8. When adjustment knob 9 is tightened, therefore slide rail 7 is essentially clamped between the braking surfaces of brake bearing block 8 and thrust bearing block 13 as described more fully below. Depending on the coefficient of friction, the desired braking effect arises.

Basically, the slide rail 7 can be made as a flat rail and to a certain extent can be rotated from the position shown so as to present relatively larger brake surfaces than result from the illustrated position of the slide rail 7 edgewise toward the blocks 8 & 13. More sensitive adjustment is, however, possible when the embodiment is designed as shown such that slide rail 7 is made as a flat rail and is located with its major surfaces oriented parallel to the longitudinal axis of crosspiece 6, so that brake bearing block 8 and thrust bearing block 13 engage the narrow sides of slide rail 7. This is apparent in FIG. 5. On the tops and bottoms of slide rail 7, it is free from brake bearing block 8, and the brake surfaces act only on the narrow sides.

Nothing has yet been said about how the force is applied from by the adjustment knob 9 to brake bearing block 8. There are many possibilities here. The embodiment shows that adjustment means 15 in crosspiece 6 has a wedge gearing 14 which is coupled to the brake bearing block 8 and which is actuated by knob 9, which is attached externally of crosspiece 6. It is apparent that there is an opening 16 in crosspiece 6 in which the threaded rod of wedge gearing 14 penetrates the wall of crosspiece 6, so that actuation knob 9 can be screwed on from the outside. To allow motion of wedge gearing 14, on the opposite side of the crosspiece 6 there is another opening 16', which is shown especially clearly in FIG. 5. Rotation of knob 9 moves rod 14*a* crosswise (diagonally) of the crosspiece 6 together with the obliquely cut sleeve 14*b* mounted thereover. Since the obliquely cut end of sleeve 14*b* is in engagement with an obliquely cut facing end of the brake bearing block 8, drawing of the sleeve against the facing end of the brake bearing block 8 produces a force which shifts the block 8 against the rail 7, thereby increasing the frictional forces applied. A return spring (not shown) can be provided between the thrust bearing block 13 and the facing end of the brake bearing block 8 for moving the brake bearing block 8 away from rail 7 when the knob 9 is turned in the opposite direction for moving the obliquely cut end of sleeve 14*b* away from the obliquely cut facing end of the brake bearing block 8.

Furthermore, FIG. 5 shows that there is an insert body on the end of crosspiece 6 which insert body has an inner thread 17 which is used to attach crosspiece 6 to support frame 1. Thrust bearing block 13 is connected to the inner side of the insert body.

FIG. 5 shows the adjustment means 15 for one end of crosspiece 6 with the slide rail 7 there. Corresponding adjustment means 15 can also be assigned to the other slide rail 7 at the other end of crosspiece 6. Uniform adjustment of braking force, however, can be obtained more likely by only one adjustment means 15 being located on crosspiece 6, by which then the two brake bearing blocks 8 are actuated when there are two slide rails 7 and brake bearing blocks 8. This is one preferred embodiment.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A furniture component with coupled backrest and seat adjustment having a braking means comprising a support frame with a slide rail to be attached to one of the movable part and the support frame, and with a hollow crosspiece with a brake bearing block to be attached to the other one of the support frame and movable part, and adjustment means for adjusting of braking force exerted by the brake bearing block on the slide rail; wherein the crosspiece has through-openings through which the slide rail penetrates the crosspiece; wherein the brake bearing block is located within the crosspiece and extends into an area of said through-openings for the slide rail; and wherein the adjustment means is located on the crosspiece and presses the brake bearing block in the crosspiece against the slide rail.

2. Furniture component as claimed in claim 1, wherein a thrust bearing block is fixed in the crosspiece on a side of the slide rail facing away from the brake bearing block, the adjustment means pressing the slide rail against the thrust bearing block via said brake bearing block.

3. Furniture component as claimed in claim 2, wherein the slide rail is a flat rail having relatively wide surfaces and narrow sides, and is oriented with said relatively wide surfaces parallel to a longitudinal axis of crosspiece; and wherein said brake bearing block engages the narrow sides of the slide rail.

4. A furniture component as claimed in claim 3, wherein the brake bearing block within the crosspiece has a through-hole for the slide rail aligned with the through-openings for the slide rail provided in the crosspiece.

5. Furniture component as claimed in claim 1, wherein the slide rail is a flat rail having relatively wide surfaces and narrow sides, and is oriented with said relatively wide surfaces parallel to a longitudinal axis of crosspiece; and wherein said brake bearing block engages the narrow sides of the slide rail.

6. A furniture component as claimed in claim 5, wherein the brake bearing block within the crosspiece has a through-hole for the slide rail aligned with the through-openings for the slide rail provided in the crosspiece.

7. Furniture component as claimed in claim 1, wherein said adjustment means comprises a wedge gearing which is coupled to the brake bearing block internally of the crosspiece and an actuation knob is attached to the wedge gearing externally of the crosspiece.

8. A furniture component as claimed in claim 1, wherein a low static friction interface is provided between a contact surface of said brake bearing block and said slide rail for increasing adjustment sensitivity of the adjustment means and for minimizing starting jerk when initiating movement of the seat.

9. A furniture component as claimed in claim 1, wherein the brake bearing block within the crosspiece has a through-hole for the slide rail aligned with the through-openings for the slide rail provided in the crosspiece.

* * * * *